United States Patent [19]

Huffman

[11] Patent Number: 5,005,835

[45] Date of Patent: Apr. 9, 1991

[54] GOLF SWING HEAD MOVEMENT MONITORING APPARATUS

[75] Inventor: Russell B. Huffman, Los Osos, Calif.

[73] Assignee: Value Engineering Co., Los Osos, Calif.

[21] Appl. No.: 379,811

[22] Filed: Jul. 14, 1989

[51] Int. Cl.[5] ..... A63B 69/36

[52] U.S. Cl. ..... 273/183 B; 273/DIG. 17

[58] Field of Search ..... 273/183 B, 190 R, 190 A, 273/186 A, DIG. 17; 340/575

[56] References Cited

U.S. PATENT DOCUMENTS

| | | | |
|---|---|---|---|
| 2,191,683 | 2/1940 | Roberts | 273/183 B |
| 3,025,064 | 3/1962 | Floud | 273/183 B |
| 3,063,721 | 11/1962 | Jackson et al. | 273/183 B |
| 3,156,211 | 11/1964 | Mallory, Jr. | 273/183 B |
| 3,368,817 | 2/1968 | Duncan | 273/183 B |
| 4,272,764 | 6/1981 | Herr et al. | 340/575 |
| 4,502,035 | 2/1985 | Obenauf et al. | 273/183 B |
| 4,869,509 | 9/1989 | Lee | 273/183 B |

*Primary Examiner*—George J. Marlo

*Attorney, Agent, or Firm*—Fleit, Jacobson, Cohn, Price, Holman & Stern

[57] ABSTRACT

An electromechanical switch mounted on head gear at an angle to the horizontal and wired to a control unit placed adjacent to a golfer's ear, adjustable for each particular golfer based on personal golf swing, capable of producing an audible sound at a predetermined time during a golfer's swing and self resetting after the tone is sounded to teach consistency of swing and optimum head movement during swing. The audible sound is produced only upon proper rotational movement of the golfer's head due to the angled positioning of the switch.

14 Claims, 3 Drawing Sheets

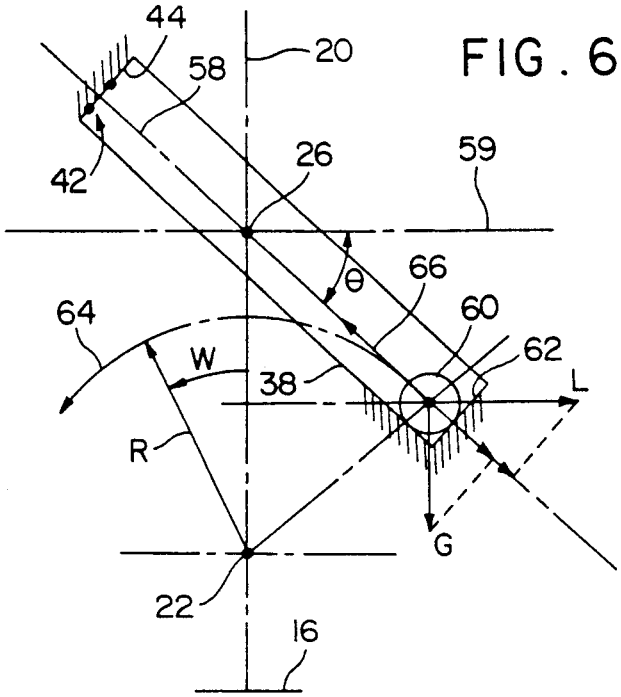
FIG. 6
FIG. 7
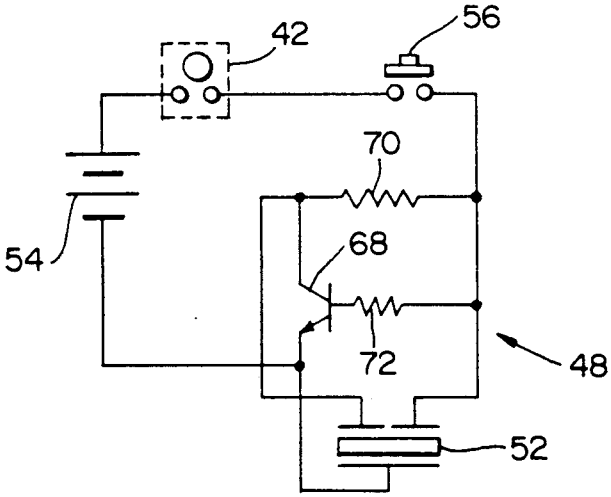
FIG. 8
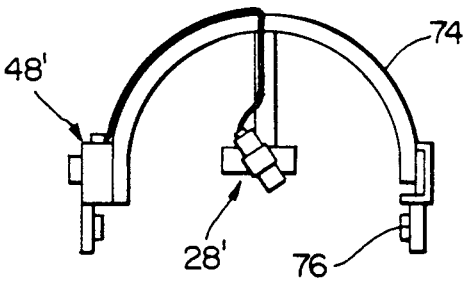
FIG. 9
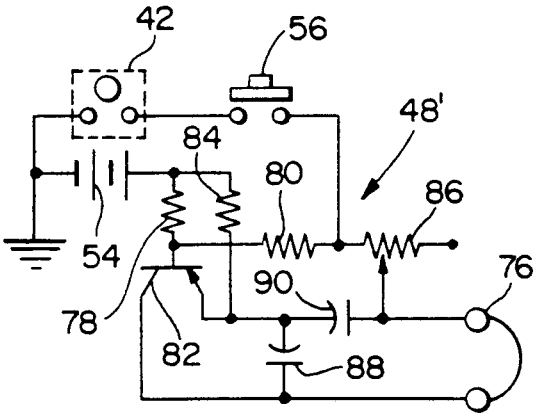

GOLF SWING HEAD MOVEMENT MONITORING APPARATUS

BACKGROUND OF THE INVENTION

This invention relates to a device for monitoring the movement of a golf player during a golf swing for the purpose of enabling a golfer to improve such swing.

The provision of devices mounted on the headdress of a golfer to monitor angular motion while executing a golf swing is already well known in the art. Motion monitoring devices mounted on a hat or cap worn by the player are disclosed for example in U.S. Pat. Nos. 3,025,064, 3,156,211, 4,272,764 and 4,502,035. Head-mounted motion sensing devices are also disclosed in U.S. Pat. Nos. 2,191,683 and 3,063,721. The devices disclosed in the aforementioned U.S. Pat. Nos. 4,272,764 and 4,502,035 to Hare et al and Openouf et al respectively function to inhibit sleep and inform the golfer that corrections are needed during the swing.

The prior art in general and the disclosures in all of the foregoing prior patents in particular lack facilities for accommodating the swing dynamics peculiar to each individual golfer in order to inform the golfer that an optimum head motion profile has been achieved based on parameters affected by speed, strength, rotation and swing style of the individual golfer.

It is accordingly an important object of the present invention to provide a head-mounted motion monitoring device for golfers which is infinitely adjustable so as to accommodate golf swing parameters for the individual golfer in order to provide an indication of the establishment of an optimum motion profile for the individual golfer.

SUMMARY OF THE INVENTION

In accordance with the present invention, the optimum motion profile of a golfer's head movement during the swing of a golf club is indicated by means of apparatus mounted on the golfer's headdress, which includes a motion monitoring detector having a movable contact guided for movement between end positions of a guide tube mounted at an adjusted angle to horizontal ground. In order to accommodate the individual golfer's swing dynamics, the movable contact is displaced from one of the end positions at rest under gravitational bias to the opposite end position at which a sensing switch is located. Thus, actuation of the sensing switch occurs in response to displacement of the movable contact within the guide tube under a varying accelerating force opposed by components of gravity and a varying lateral force acting on the movable contact, such varying forces being induced as a result of the rotation, swing acceleration and lateral motion of the golfer's head during a golf swing. The aforementioned forces generated during the golf swing will depend on the speed, strength and golf swing style of the individual golfer swing to cause displacement of the movable contact into engagement with the contacts of the sensing switch if in conformance with an optimum motion profile established by adjustment of the angular orientation of the guide tube for the individual golfer.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

FIG. 1 is a front elevational view of a golfer in a static position at the beginning of the active portion of a golf swing, in operatively spaced relationship to a teed golf ball, with motion monitoring apparatus being carried on the golfer's cap in accordance with one embodiment of the present invention.

FIG. 1*a* is a schematic view at right angles to that of FIG. 1, showing certain geometrical relationships.

FIG. 6 is a diagram illustrating the geometrical and dynamic relationships associated with the motion monitoring detector associated with the apparatus as illustrated in FIGS. 2–5.

FIG. 7 is an electrical circuit diagram associated with the motion monitoring apparatus illustrated in FIGS. 1–6.

FIG. 8 is a front elevation view of a motion monitoring apparatus and mounting arrangement in accordance with another embodiment of the present invention.

FIG. 9 is an electrical circuit diagram associated with the motion monitoring apparatus depicted in FIG. 8.

DETAILED DESCRIPTION OF THE PREFERRED EMBODIMENTS

Figure 1:
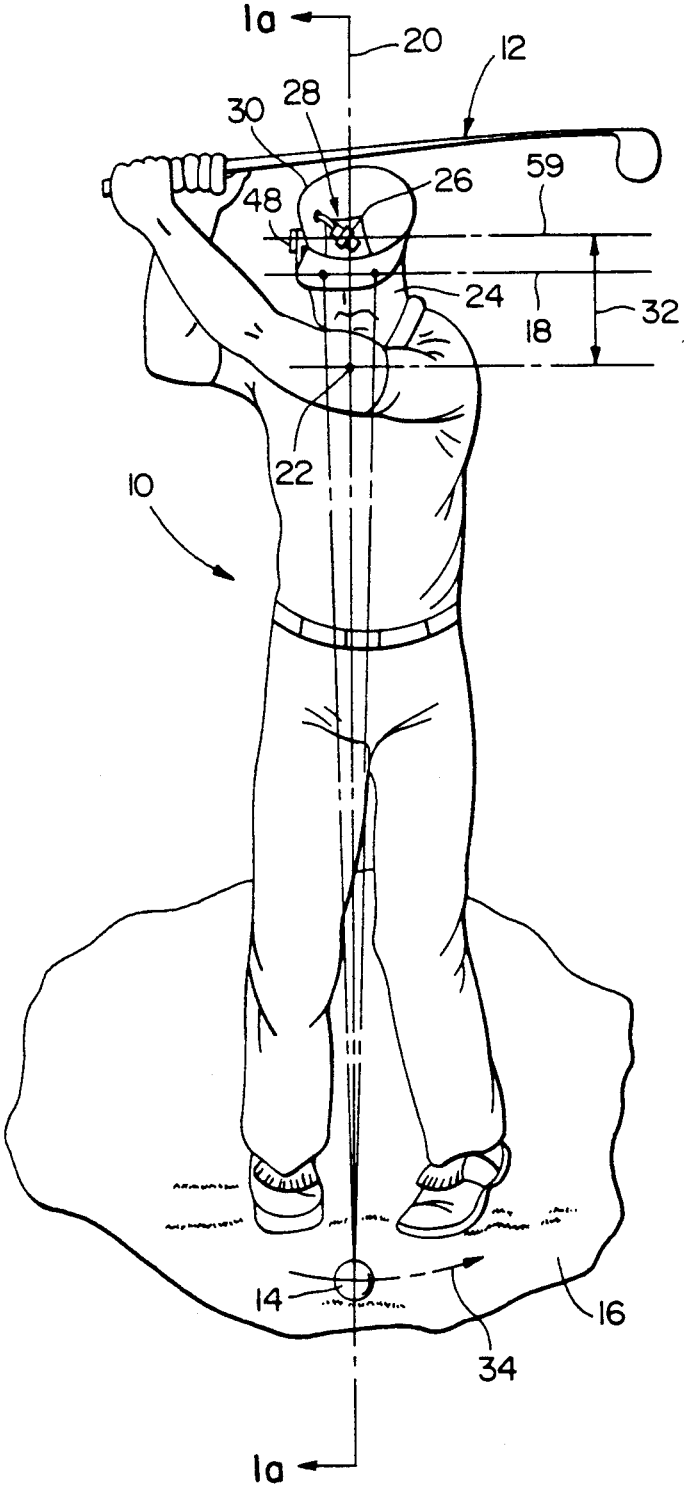
Figure 1A:
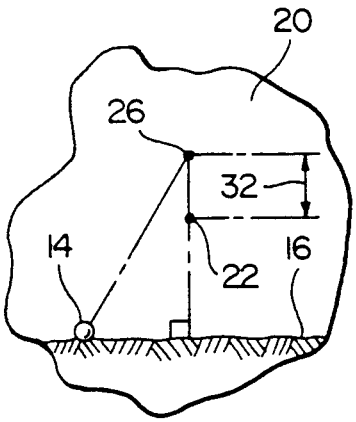

Referring now to the drawing in detail, FIG. 1 illustrates a golfer generally referred to by reference numeral 10 in a static position at the beginning of an active phase in the swing of a golf club 12 for the purpose of driving a golf ball 14 properly supported in a teed position on horizontal ground 16 in front of the golfer. In such static position of the golfer as shown in FIG. 1, the golfer's eyes are aligned with a centerline 18 parallel to horizontal ground for focusing on the golf ball 14 which is aligned along a line of sight plane 20 with a rotational center 22 approximately within the neck area of the golfer about which the golfer's head 24 is rotatable during the swing. The line of sight plane 20, which is perpendicular to horizontal ground, intersects an intermediate sensor point 26 on a motion detector 28 forming part of the head movement monitoring apparatus mounted on the head of the golfer by means of a golfer's cap 30. The vertical distance 32 perpendicular to ground 16 within the line of sight plane 20 between the center of rotation 22 and the intermediate sensor point 26 as more clearly shown in FIG. 1*a*, is determined to be approximately 8 inches. Based on such geometrical relationships, the motion of the ensuing phase of the golf swing during which the golf ball 14 is driven from the stationary position in the direction of arrow 34 (as shown in FIG. 1) by impact with the golf club 12, will be monitored by the motion detector 28 in accordance with the present invention.

Figure 2:
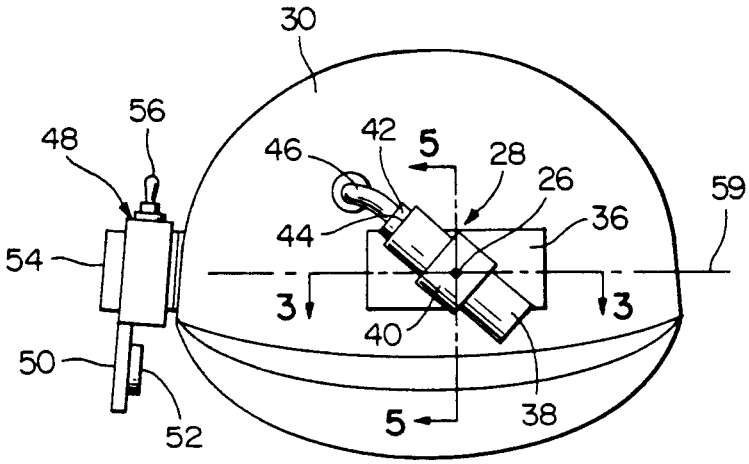
FIG. 2 is an enlarged front elevational view of the cap mounted motion monitoring apparatus shown in FIG. 1.
Figure 3:
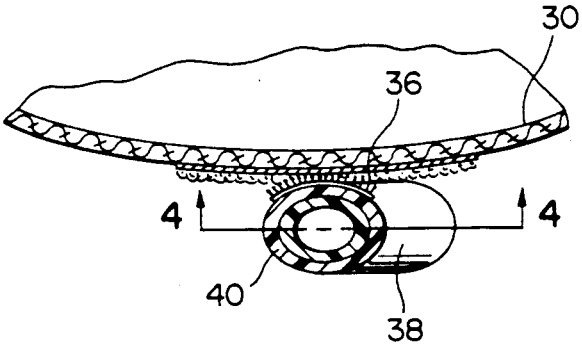
FIG. 3 is an enlarged partial section view taken substantially through a plane indicated by section line 3—3 in FIG. 2.
Figure 5:
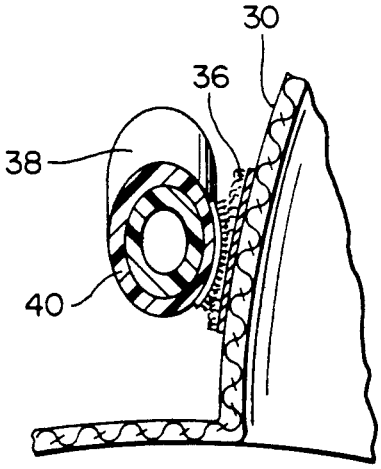
FIG. 5 is an enlarged partial section view taken substantially through a plane indicated by section line 5—5 in FIG. 2.

FIGS. 2, 3 and 5 illustrate in greater detail the mounting of the motion monitoring apparatus on the golfer's cap 30 in accordance with one embodiment of the invention. Secured to the front of the cap at the proper location to establish the geometrical relationships depicted in FIG. 1, is a suitable holder such as a "Velcro" strip 36. The mounting of the apparatus will now be discussed with respect to FIG. 2. An axially elongated guide portion of detector 28, in the form of a cylindrical tube 38, is mounted in an adjusted angular position on the "Velcro" holder 36 by means of an encircling band 40 having a mating contact portion thereon. The contacts of a sensing switch 42 at one axial abutment end 44 of the guide tube 38 are electrically connected, through a cable 46 extending through the cap 30, to a control unit 48 of the motion monitoring apparatus as more clearly seen in FIG. 2. A support arm 50 projects from the unit 48 so as to mount an audible signal emitting device 52, which is thereby operatively positioned adjacent to the ear of the golfer wearing the cap 30. A battery power source 54 is mounted in the control unit 48 which also mounts an on-off switch 56.

Figure 4:
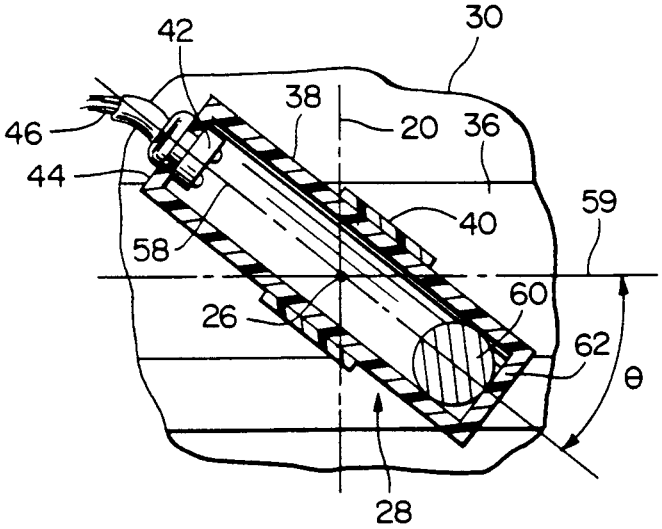
FIG. 4 is an enlarged partial section view taken substantially through a plane indicated by section line 4—4 in FIG. 3.

Referring now to FIG. 4, the guide tube 38 is supported in an adjusted angular position relative to the golfer in the static position shown in FIG. 1 at a predetermined angle Θ between its longitudinal axis 58 intersecting the intermediate sensor point 26 and horizontal ground as represented in FIG. 4. The angle Θ is of a value established by infinite angular adjustment of the guide tube 38 by the individual golfer as hereinbefore indicated. The guide tube 38 encloses a spherical contact element 60 made of electrically conductive material and dimensioned to be constrained for slidable movement along the axis 58 of the guide tube between an upper limit position engaging the contacts of sensing switch 42 at the abutment end 44 and a lower position engaging the opposite abutment end 62 of the guide tube. The movable contact element 60 is shown at rest in engagement with the lower abutment end 62 in FIG. 4 under the bias of gravity.

With reference to FIG. 6, a mechanical force vector diagram derived from FIGS. 1, 2 and 4. The movable contact element 60 is held in its position of rest engaging the lower abutment end 62 of the guide tube by a constant gravitational force (G). During the ensuing golf swing and motion of the golfer's head, the movable contact element 60 undergoes angular movement in the direction of arrow 64 about the rotational center 22 of the golfer's head. Such angular movement is characterized by a radius of rotation (R) that is variable as the contact element 60 moves along axis 58 at a variable angular velocity (w). The angular velocity (w) and radius of rotation (R) are functions of the accelerating force 66 applied to the movable contact element 60, during the swing, along the axis 58 of the guide tube. Such accelerating force 66 is opposed by components, along axis 58, of the constant gravitational force (G) and a variable lateral force (L) exerted by the golfer during the swing. Thus, the magnitude of the accelerating force 66 in relation to the opposing components of the gravitational and lateral forces as depicted in FIG. 6 will control upward displacement of the movable contact element 60 along the axis 58 of the guide tube as the movable contact element is displaced with the golfer's head about the rotational center 22. The initial angle of rest (Θ) measured between the horizontal axis through the sensing device 59 and the axis of the guide tube 58, to which the guide tube is adjusted in the static position of the golfer will affect the magnitude of the force components along axis 58 and the accelerating force 66 to influence upward displacement of the movable contact. To insure the upward displacement necessary for proper functioning the angle of rest (Θ) must be greater than 0° and less than 180°, the guide tube, therefore cannot be parallel to the horizontal ground. Appropriate angular adjustment in accordance with the individual golfer will therefore enable one to predetermine displacement of the movable contact necessary to achieve engagement with the sensing switch 42 at the abutment end 44 of the guide tube, corresponding to an optimum motion profile for the golfer's head motion during the swing. When such optimum motion profile is achieved as reflected by actuation of the sensing switch 42, an indicating signal is generated as will be described hereinafter.

The control unit 48 hereinbefore referred to with respect to FIG. 2, embodies an electrical circuit as diagrammed in FIG. 7 pursuant to one embodiment of the invention. As shown in FIG. 7, the battery source of power 54 has its positive terminal connected through on-off switch 56 to the sensing switch 42 to complete an energizing circuit through a piezo-crystal transducer type of audible device 52 in series with a transistor 68 connected in parallel with resistor 70. The transistor 68 is switched on by a positive bias voltage applied through switches 56 and 42 and resistor 72 to its base causing the device 52 to generate an audible signal indicating establishment of an optimum motion profile.

According to the embodiment illustrated in FIG. 8 the motion detector 28' as hereinbefore described is carried by a head band having earphones 76 at both ends to be positioned over the ears of the golfer. The earphones are connected to a control unit 48' embodied by the electrical circuit of FIG. 9, in which a negative ground terminal of the battery 54 is connected to on-off switch 56 in series with the sensing switch 42 associated with the detector 28' of FIG. 8. Closing of both switches 56 and 42 completes a circuit to ground from the positive terminal of battery 54 through a base biasing resistor 78 and a load resistor 80 causing transistor 82 to switch on. A sound generating circuit is thereby established through transistor 82 across the earphones 76 in series with resistor 84 and adjustable resistor 86 to generate an audible signal. Capacitor 88 is connected across the emitter and collector electrodes of the transistor 82 while a capacitor 90 is connected in series between the emitter and earphones for proper signal generation.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. Apparatus for signifying an optimum motion profile of a golfer's head about a rotational center which is in alignment with a golf ball along a line of sight plane perpendicular to horizontal ground in a static position of the golfer, said apparatus including an article of golfer's headwear, a movable contact element, a sensing device engageable by said contact element, guide means for guiding movement of the contact element along a predetermined path from a position at rest to a limit position at which the contact element engages the sensing device, means mounting the guide means on the article of golfer's headwear for controlling movement of the contact element along said path in response to said rotation of the golfer's head during swing of a golf club from said static position of the golfer, adjusting means for locating the guide means on the mounting means at a predetermined angle relative to but not parallel with said horizontal ground in the static position of the golfer and signal generating means connected to a sensing device for indicating engagement of the contact element therewith and emitting a signal corresponding to achievement of said optimum motion profile during said swing of the golf club only when the contact element engages the sensing device.

2. The device as defined in claim 1 wherein said movement of the contact element occurs in response to acceleration force exerted thereon by said rotation of the golfer's head in excess of opposing components of forces along the path of the guide means which are applied during said swing of the golfer's club.

3. The device as defined in claim 2 wherein said acceleration force and the opposing components of the forces along the guide means are dependent upon by an adjusted angular relationship of the guide means to the horizontal ground in said static position of the golfer to establish said optimum motion profile.

4. The device as defined in claim 3 wherein said guide means comprises an elongated tube within which said movement of the contact element is confined, said tube having opposite abutment ends at which said position of rest and said limit position are respectively established and means fixedly mounting the sensing device at one of the abutment ends of the guide tube at which the limit position is established.

5. The device as defined in claim 4 wherein said mounting means is a head fitted element positioned on the golfer carrying the tube at said adjusted angular relationship with the horizontal ground to which the guide means is angularly adjusted through the angular adjusting means.

6. The device as defined in claim 5 wherein said line of sight plane intersects the guide tube intermediate said opposite abutment ends thereof.

7. The device as defined in claim 6 wherein said movable contact element is a sphere made of electrically conductive material.

8. Apparatus for monitoring movement of a golfer's head relative to horizontal ground in a static position of the golfer, including an article of golfer's headwear, a movable contact element, a sensing device engageable by said contact element, guide means for guiding movement of the contact element along a predetermined path from a position at rest to a limit position at which the contact element engages the sensing device, means mounting the guide means on the article for effecting said movement of the contact element along the path of the guide means in response to swing of a golf club, adjusting means for locating the guide means on the mounting means at a predetermined angular position of the path, relative to but not parallel with said horizontal ground, corresponding to an optimum motion profile of said movement of the golfer's head and signal generating means connected to the sensing device for emitting a signal indicating achievement of said optimum motion profile during said swing of the golf club in response to said engagement of the sensing device by the contact element in the limit position thereof.

9. The device as defined in claim 8 wherein said movement of the contact element is induced by acceleration force applied thereto and opposed by components of forces along the angularly upward path of the guide means dependent on said predetermined angular position of the guide means.

10. The device as defined in claim 9 wherein said guide means comprises an elongated tube within which said movement of the contact element along the path is established, said tube having opposite abutment ends at which said position of rest and said limit position are respectively established and means fixedly mounting the sensing device at one of the abutment ends of the guide tube at which the limit position in established.

11. A motion profile detector adapted to be mounted on a golfer in a static position, including an article of golfer's headwear, a guide tube having opposite abutment ends, means for mounting the tube on the article of headwear at an angle to the horizontal, a movable contact element displaceable within said guide tube between said opposite abutment ends thereof, means for adjustably positioning the guide tube in a predetermined angular orientation with respect to horizontal ground gravitationally holding the contact element in engagement with one of the opposite abutment ends in the static position of the golfer and sensing means for detecting engagement of the contact element with the other of the opposite abutment ends of the guide tube in response to displacement of the contact element under accelerating forces generated by rotation of the golfer's head during swing of a golf club.

12. In combination with the detector as defined in claim 11, means responsive to said engagement of the contact element detected by the sensing means for indicating achievement of an optimum motion profile during said swing of the golf club.

13. A device for signifying an optimum motion profile of a golfer's head about a rotational center housed in a cylindrical casing on an article of golfer's headwear comprising:

a power source;
a first switch for enabling operation of said device;
a second switch connected at one end to said first switch for sensing optimum motion;
a moveable contact element for engaging said second switch upon optimum motion; and
audible signal means coupled to said power source and activated upon enabling of said first and second switches.

14. A device for signifying an optimum motion profile of a golfer's head about a rotational center comprising:

a power source;
a first switch connected to one terminal of said power source, for enabling operation of said device;
a second switch, connected at one end to said first switch for sensing optimum motion;
a moveable contact element for engaging said second switch upon optimum motion;
earphones;
a transistor connected across said earphones; and
a plurality of resistors, connected to said transistor, for switching on said transistor upon engagement of said first and second switches generating an audible signal.

* * * * *